US007806179B2

(12) United States Patent
Coronado et al.

(10) Patent No.: US 7,806,179 B2
(45) Date of Patent: Oct. 5, 2010

(54) STRING MOUNTED HYDRAULIC PRESSURE GENERATING DEVICE FOR DOWNHOLE TOOL ACTUATION

(75) Inventors: Martin P. Coronado, Cypress, TX (US); Carl W. Stoesz, Houston, TX (US); Luis E. Mendez, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 319 days.

(21) Appl. No.: 11/759,459

(22) Filed: Jun. 7, 2007

(65) Prior Publication Data

US 2008/0302527 A1 Dec. 11, 2008

(51) Int. Cl.
*E21B 17/00* (2006.01)
*E21B 17/07* (2006.01)
*E21B 23/00* (2006.01)
*E21B 23/04* (2006.01)

(52) U.S. Cl. ..... 166/242.7; 166/373; 166/187; 166/381; 166/319

(58) Field of Classification Search ..... 166/242.7, 166/373, 381, 334.1, 319, 212, 120, 187
See application file for complete search history.

(56) References Cited

U.S. PATENT DOCUMENTS 3,032,116 A 5/1962 Barry
3,575,237 A 4/1971 Malone
3,575,238 A 4/1971 Shillander
3,712,387 A * 1/1973 Vincent et al. ..... 173/73
5,297,633 A * 3/1994 Snider et al. ..... 166/387
5,558,162 A * 9/1996 Manke et al. ..... 166/319
5,580,114 A 12/1996 Palmer
5,615,741 A 4/1997 Coronado
5,897,095 A 4/1999 Hickey
6,349,772 B2 2/2002 Mullen et al.
6,634,428 B2 10/2003 Krauss et al.

OTHER PUBLICATIONS

Gai, Huawen, et al., "Monitoring and Analysis of ECP-Inflation Status Using Memory-Gauge Data", SPE Drilling & Completion, Sep. 1997, 203-207.
Milanovic, D., et al., "A Case History of Sustainable Annulus Pressure in Sour Wells—Prevention, Evaluation and Remediation", SPE 97597, May 2005, 1-19.
Hill, Leo E., et al., "Completion Tools Proven Successful in Deepwater Frac Packs and Horizontal Gravel-Packing", IADC/SPE 74492, Feb. 2002, 1-15.
Ross, Colby, et al., "Weight Down System for Floaters", SPE 73774, Feb. 2002, 1-13.

* cited by examiner

*Primary Examiner*—William P Neuder
*Assistant Examiner*—Cathleen R Hutchins
(74) *Attorney, Agent, or Firm*—Steve Rosenblatt

(57) ABSTRACT

Two subs are held in a fixed position relative to each other when assembled to a string and run into a wellbore. A reservoir of fluid is defined in a wall between the subs. The reservoir has one or more outlets connected by a short jumper line to an adjacent tool to be operated. At the appropriate time, set down weight breaks a shear pin to reduce the reservoir volume and create pressure in the exit lines. The exit lines can be connected to operating pistons in adjacent tools to actuate them or to perform other desired functions using a stream of pressurized fluid. The device can be set for one time or multiple cycles where fluid in the reservoir can be replenished and re-pressurized for multiple cycles of operation.

19 Claims, 5 Drawing Sheets

STRING MOUNTED HYDRAULIC PRESSURE GENERATING DEVICE FOR DOWNHOLE TOOL ACTUATION

FIELD OF THE INVENTION

The field of this invention is downhole tool that require hydraulic pressure to perform a function and a way of generating that pressure without resort to a control line extending from the surface where that pressure is generated or pressure transmitted through the well tubulars and instead using string manipulation to locally generate the pressure to perform a downhole function.

BACKGROUND OF THE INVENTION

A wide variety of tools for downhole applications are operated on supplied fluid pressure. One of the most common ways to supply hydraulic pressure to downhole components in a bottom hole assembly is to run a control line from the surface. A control line is secured outside a tubing string and connected at the surface to a source of fluid pressure and at the other end to a housing of a downhole tool. Generally, when pressure is applied from the surface through the control line it is communicated to the tool housing where it moves a piston that actuates the tool to perform a downhole operation. Subsurface safety valves commonly operate this way. They are designed to stay in the open position as long as control line pressure is applied. Applying pressure compresses a return spring acting on the flow tube. Applying pressure shifts the flow tube to rotate a flapper to hold the valve open. A loss of control line pressure allows the spring to return the flow tube up to allow the flapper to close generally under the further bias of a pivot pin mounted spring.

Other variations involve using internal tubing pressure applied form the surface. In these designs there is a ball seat that receives a ball. When the ball has landed pressure can be built up to actuate the tool. In some designs the ball on the seat can be blown out with a further increase in pressure beyond what it took to operate the tool so that the internal passage in the tool is at least partially cleared for running other tools even further into a well. These designs require special features and can shock a formation below when the ball and its seat are blown out or alternatively when the ball is blown through the seat.

Sometimes tools designed for one job are retrofitted to other jobs but require modification to function in the new application. For example downhole wet connects are devices that mate an upper portion of a string to a lower portion. These devices feature an orientation pin on one half of a connection and a longitudinal groove usually having a broad tapering entrance to initially grab the alignment pin and cause some relative rotation so that the two parts of the string can be mated downhole. Wet connects generally connect the main bores in the upper and lower tubular strings as well as connecting adjacent conduits for such purposes as a control line for a subsurface safety valve, for example. Once wet connect connections are fully mated, they generally need to be locked together and such locks or anchors have been in the past actuated with hydraulic pressure from an available adjacent control line that the wet connect mated to its downhole counterpart segment. However, some wet connects are not designed to couple hydraulic control lines so a ready source of hydraulic pressure was not available for such designs. One design that connected fiber optic cables had no available hydraulic sources but still needed to be locked in a connected mode. It was this need to adapt a known design for a new application that drove to the discovery of the present invention that not only solved the problem of locking that connection together but further has application in a wide variety of situations where hydraulic pressure is needed for a variety of purposes. In the fiber optic wet connect, for example, not only was hydraulic pressure needed to lock the connection together, but there was a need to clean the fiber cable ends of one or more cable end pairs before the connection was driven home to get drilling fluid or other solids that might impede signal transmission through the cable connection out of the way. The present invention addresses a problem in this context, in a preferred embodiment but its application is far more universal to a wide variety of tools. Variations are also possible to allow multiple pressure sources to deliver pressure to various locations with a single or multiple manipulations of the string. One time operation with a single string manipulation is envisioned as well as multiple actuations from a series of string manipulations with multiple reservoirs or reservoirs that can recharge for reuse. Details of these alternatives will be more readily apparent to those skilled in the art from a review of the description of the preferred embodiment and the associated drawing while recognizing that it is the claims that contain the full scope of the invention.

SUMMARY OF THE INVENTION

Two subs are held in a fixed position relative to each other when assembled to a string and run into a wellbore. A reservoir of fluid is defined in a wall between the subs. The reservoir has one or more outlets connected by a short jumper line to an adjacent tool to be operated. At the appropriate time, set down weight breaks a shear pin to reduce the reservoir volume and create pressure in the exit lines. The exit lines can be connected to operating pistons in adjacent tools to actuate them or to perform other desired functions using a stream of pressurized fluid. The device can be set for one time or multiple cycles where fluid in the reservoir can be replenished and re-pressurized for multiple cycles of operation.

DETAILED DESCRIPTION OF THE PREFERRED EMBODIMENT

Figure 1:
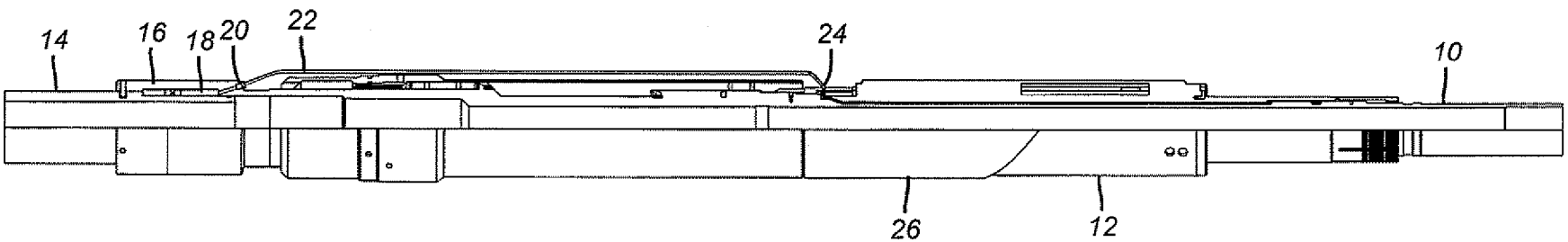
FIG. 1 is a section view of a first embodiment of the invention used in conjunction with the anchor portion of a wet connect.

FIG. 1 illustrates an anchor section 10 of the upper half of a wet connect having the upper connector portion 12 at its upper end. The lower half of the wet connect assembly containing the other connector mate is not shown. An upper string 14 extends into a sub 16 that defines an internal recess 18 with an outlet 20. A hydraulic line 22 extends from outlet 20 and is connected to in the preferred embodiment to a connection 24 that actuates a lock between the upper portion of the wet connect 12 and the lower portion of the wet connect after they are pushed together and weight is set down on the upper string 14.

Figure 2:
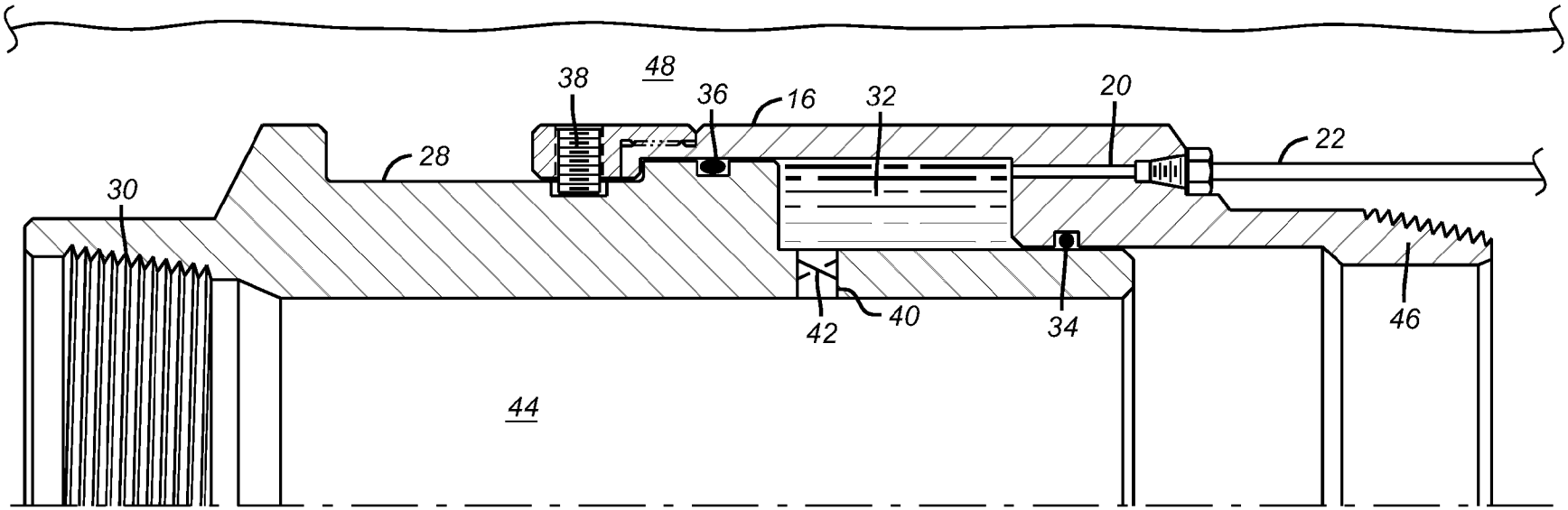
FIG. 2 is a section view of the subs that define a chamber to be pressurized when weight is set down.

FIG. 2 shows how hydraulic pressure is generated locally to lock the wet connect in FIG. 1 in a way other than the prior design that depended on a control line run to connection 24 from the surface. Top sub 28 is secured at thread 30 to the upper string 14, which is not shown in this FIG. In this embodiment, the bottom sub 16 and top sub 28 are configured to create a chamber 32 where preferably an incompressible fluid is stored to preferably fill the chamber 32. Outlet 20 communicates with chamber 32 and line 22 which leads to an anchor on the wet connect at a connection 24. From that point on the operation of the anchor is the same as if the pressure source was from a control line that started at the surface. In essence, the pressure moves a piston in the anchor to actuate it when the wet connect segments are fully pushed together engaging the locking collet threads in the anchor section 10 of the upper connector segment with a matching profile in the lower connector segment in a manner known in the art. Chamber 32 is sealed at seals 34 and 36 so that when the wet connect segments are together, setting down weight on top sub 28 will break the shear pin 38 to allow the top sub 28 to advance to reduce the volume of chamber 32 so that pressure builds up in it. That pressure passes through conduit 22 to set a downhole tool such as an anchor for a wet connect that needs to be locked together after being pushed together. It can also serve other purposes. For example, when a wet connect with two ends of a fiber optic cable is being made up, it is good to make sure the abutting exposed ends are free of debris so that the integrity of the optical connection is maintained. In another application of the embodiment shown in FIG. 2, fluid can be forced out to reach the fiber optic cable ends on the two parts of the wet connect as they come together to clean debris away from the end area of each fiber optic cable segment. This helps to insure the quality of signal transmission through the made up connection. As will be seen below, this can be accomplished with a single reservoir that not only builds pressure in line 22 that can actuate a tool but also ejects fluid through an orifice, for example, to keep the connection in a tool clean as it is being made up downhole. Those skilled in the art will realize that wholly unrelated applications are envisioned such as shifting sleeves, holding safety valves open, setting anchors or operating lock mechanisms, to name but a few possible applications. The present invention allows elimination of one or more control lines from the surface.

The mechanism of the present invention as shown in FIG. 2 can be adapted for single application or multiple applications. Without the optional passage 40 and an associated check valve 42 shown schematically in FIG. 2, an initial setting down weight will break the shear pin 38 and initiate a one time pressure buildup to operate a tool or perform another downhole function. In that version, once weight is set down the pressure is applied. In systems where some of the pressurized fluid is allowed to escape such as for a purpose of displacing debris before a downhole connection is made, the loss of fluid from the system could mean that an insufficient volume of incompressible fluid could remain to re-establish the initial pressure generated from the original settling down weight and reduction of the volume of chamber 32. However, it is possible to have a system of being able to recharge the chamber 32 with well or other fluids for example stored in other compartments in sub 28 and a way to do this is to provide a passage 40 which can optionally have a check valve 42 that only allows fluid into chamber 32 when top sub 28 is picked up. In FIG. 2 passage 40 is shown terminating in passage 44 formed by subs 28 and 46. Alternatively passage 40 can lead into the surrounding annulus 48 or to an enclosed compartment of clean fluid within sub 28 or in the string above it. Using passage 40 the chamber 32 fills when sub 28 is picked up because such movement reduces pressure in chamber 32 to allow fluids to come in. Even without a check valve 42, pressure can still be built up after recharging chamber 32 through passage 40 by advancing passage 40 beyond seal 34. This will create a vacuum upon re-charging until the port re-enters the chamber if the other end of the tube is plugged. The preferred alternative is the check valve 42.

Alternatively, with the addition of the check valve 42 any subsequent setting down of the sub 28 will close the check valve 42 and allow chamber 32 to be pressurized. Those skilled in the art will also appreciate that while a shear pin 38 is shown as holding the relative positions of subs 28 and 46, other ways of holding them together can be used that also accommodate subsequent relative movement. Clearly after the shear pin 38 is broken the sub 28 can be raised and lowered from the surface any number of times. Alternatively, a j-slot mechanism of a type known in the art can be supplied to allow relative movement between sub 28 and sub 46 in a defined range any number of times. Finally, it is worth mentioning that the embodiment of FIG. 2 because it has seals 34 and 36 is isolated from wellbore hydrostatic pressure increase as the assembly is introduced into the wellbore. The embodiments in FIGS. 3 and 4 use a floating piston to balance out wellbore hydrostatic that is an issue in those embodiments due to the different sealing arrangements from FIG. 2, as will be explained below.

Figure 3:
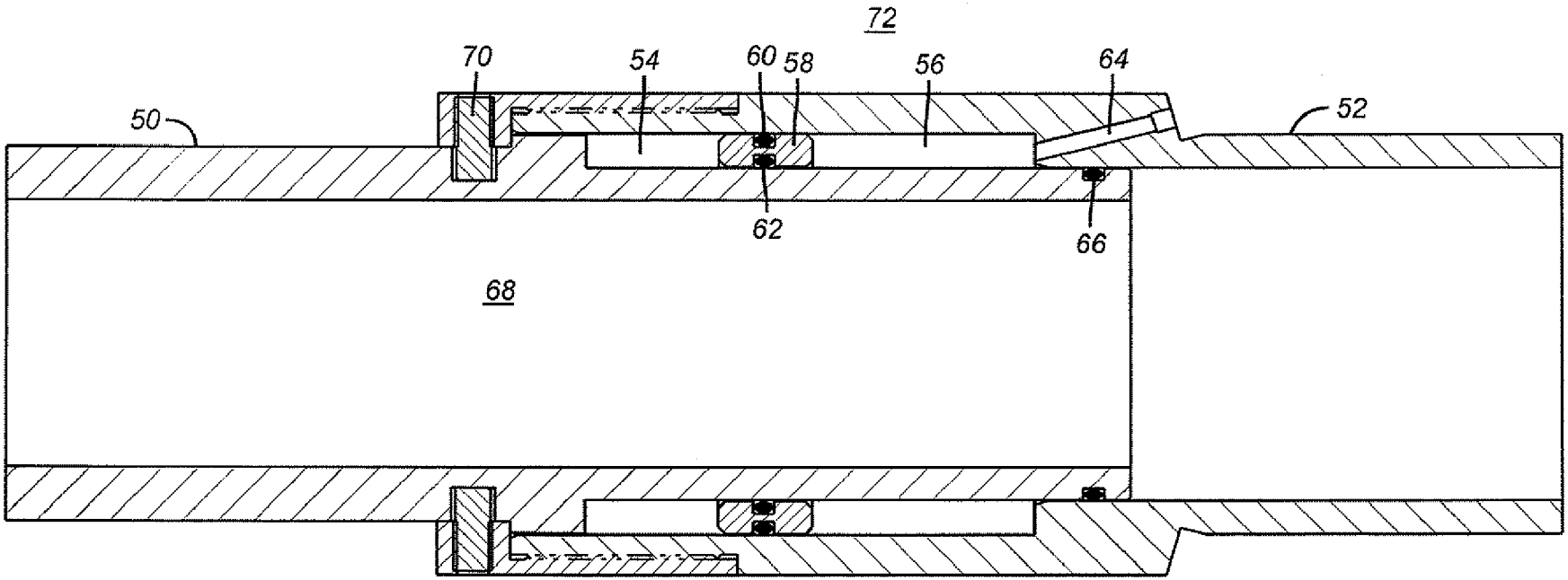
FIG. 3 is an alternative to FIG. 2 showing a floating piston in the chamber.

In FIG. 3, a top sub 50 that is supported by a tubing string that is not shown, is inserted into a bottom sub 52 defining chambers 54 and 56 that are divided by floating piston 58. Floating piston 58 has outer seal 60 and inner seal 62. Chamber 54 is not sealed and is exposed to wellbore hydrostatic pressure. Chamber 56 has an outlet 64 that goes to a tool to be operated or for flushing purposes as described above or for any other downhole use of pressurized fluid. Seal 66 isolates chamber 56 from bore 68 in the subs 50 and 52. Those skilled in the art will appreciate that movement of floating piston 58 allows the increasing hydrostatic pressure to be transferred to chamber 56 to avoid any pressure imbalances from forming inside the tool prior to operation. A shear pin 70 prevents relative movement between subs 50 and 52 until enough set down weight is applied to sub 50. Movement of sub 50 with respect to sub 52 builds pressure in chambers 54 and 56 although some leakage occurs out of chamber 54 into the annulus 72 as sub 50 is moved down. Pressure builds up in chamber 56 and is delivered though outlet 64 to perform the downhole operation with the various options again available as earlier described with regard to FIG. 2.

Figure 4:
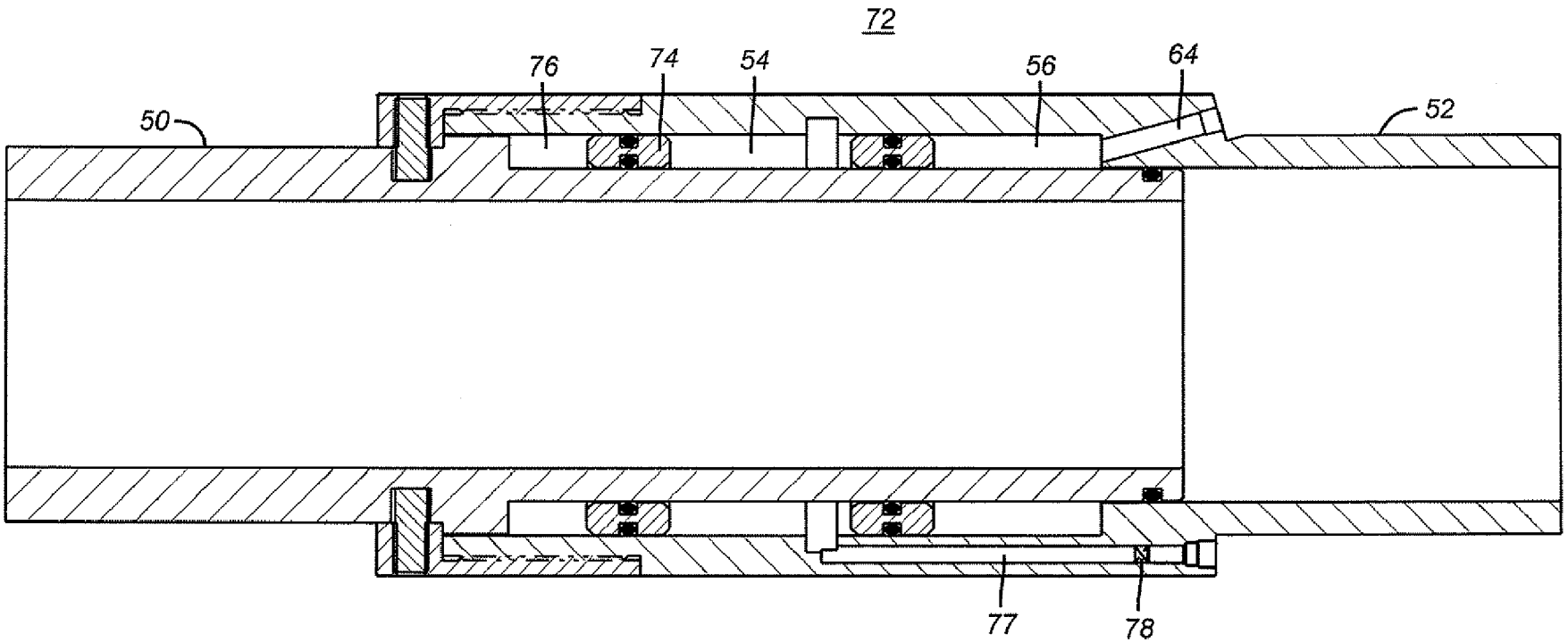
FIG. 4 is an alternative to FIG. 3 showing multiple floating pistons and multiple outlets that can be used for different purposes.

FIG. 4 is similar to FIG. 3 except that in FIG. 4 there is a second floating piston 74 and chamber 54 is isolated from annulus 72 while a new chamber 76 is provided that is not sealed from annulus 72. Setting down sub 50 pressurizes all three chambers 76, 54 and 56. Discrete fluid paths are made available as between chambers 54 and 56 through separate outlets 64 and 77. Outlet 64 can be used to lock a wet connect together while outlet 77 can be used for a fluid flush of the ends of the fiber optic cable before they are pushed together, for example. It may be desirable to sequence the action of pressure buildup on the end user tools or devices affected by them. For example, in making up a downhole wet connect it is desirable to flush the fiber optic cable ends before the connection is fully pushed together.

A way to address these conflicting needs is to put a rupture disc 78 in outlet 77. That way if outlet 64 is used to flush the ends of the fiber optic cables it can be activated first before the wet connect is fully made up. Then when that process completes and more pressure is developed with further movement of sub 50, at some point, calculated to be when the wet connect halves are abutting and are ready to be locked together, the rupture disc 78 will fail to allow the built up pressure to be communicated through passage 77 to set the anchor that locks the wet connect together. It is worth noting that if a rupture disk is placed in outlet 64 there will be a trapped fluid volume between the disk and piston in the anchor. A better way to do this is to have a low-pressure disk in outlet 77 which shears at a relatively low pressure when compared to the pressure required to shear the commit piston in the anchor. This way there is no trapped fluid volume which cannot be hydrostatically balanced.

Yet another way to do this is to allow the relative motion between subs 50 and 52 to open a port communicating with outlet 77 first to allow the connection to be washed before it is fully mated up with additional movement then closing access to port 77 so that available pressure can act through port 64 to which access only opens up after access to port 77 is closed or nearly closed to avoid fluid lock in chambers 54 and 56.

Figure 5:
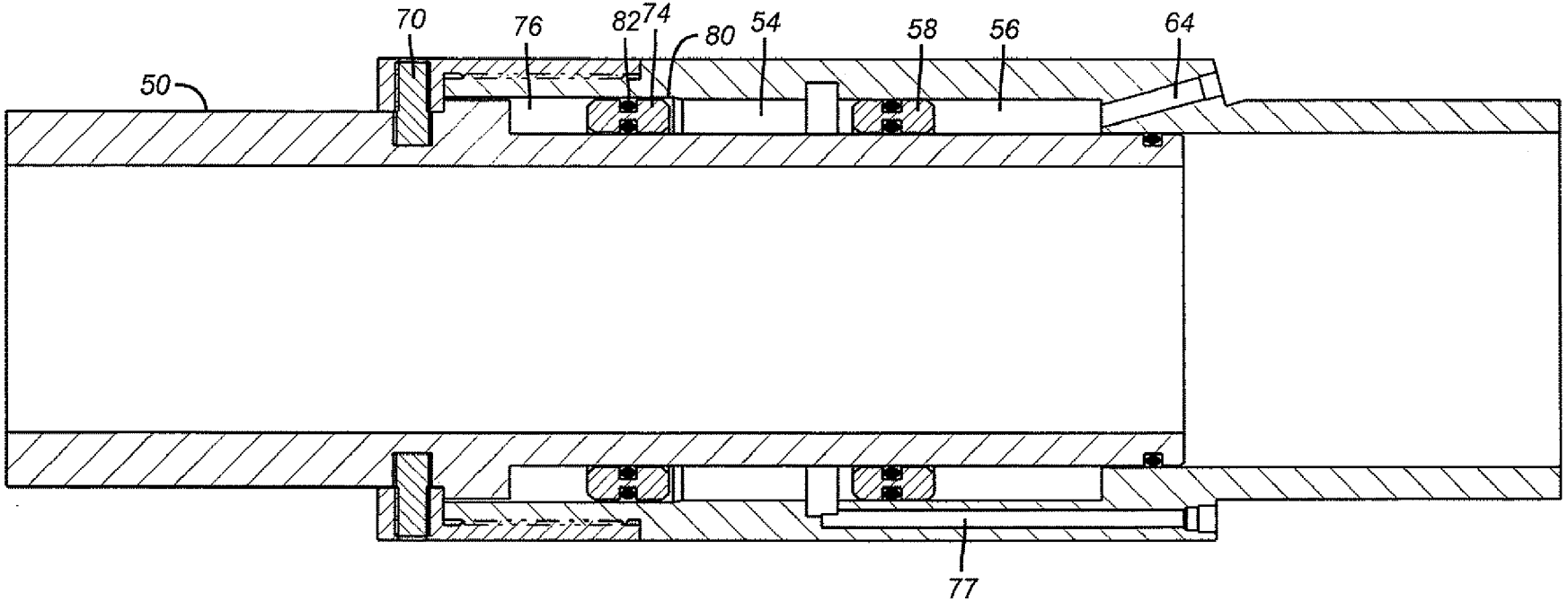
FIG. 5 is a variation of FIG. 4 showing an undercut adjacent one of the floating pistons.

FIG. 5 is a variation on FIG. 4 adding an undercut 80 at piston 74 so that seal 82 can initially be bypassed. Chamber 54 can be filled with a viscous material such as optical index matching gel to keep it in place as the assembly is run into the hole. When the shear screw 70 is sheared the contents of chamber 54 will be pushed out passage 77 for, for example, cleaning the connection before it is fully made up so that the fiber optic cables can effectively transmit signals. Eventually, piston 74 will contact piston 58 after which the contents of chamber 56 will be pushed out through connection 64. Since an actuating piston for the anchor or lock for the wet connect (not shown) is also shear pinned, the pressure has to build in chamber 56 with piston 80 against piston 58 and set down weight applied to sub 50 before the shear pin in the anchor or lock can break to actuate that tool. Again, the concept being illustrated is sequential operation of two downhole operations the details of which can vary broadly. The invention encompasses this staged actuation as well as simultaneous actuation of different or even an identical downhole device.

Those skilled in the art will appreciate that the present invention allows the elimination of a control line from the surface and replaces its operation with a pressure generation system that is localized and preferably initiated with string manipulation. Designs are presented that allow for single operation for a specific task or the ability to cycle as many times as needed to accomplish the same or different tasks. The reservoirs can be isolated from wellbore hydrostatic or compensated to neutralize its effects. A single or multiple reservoirs can be actuated either at once or in sequential order to meet the well conditions and the desired order of operations downhole. The chambers can be pre-filled for a single time fluid displacement or they can have the capability of being recharged using a passage that passes a seal or a passage with a check valve. Recharge fluid can come from the tubing, the annulus or a storage chamber for fluid provided in the string. Splines or other rotational locking features can be provided to allow for torque transmission through the subs independent of their ability to move longitudinally relative to each other to create the desired pressure to use downhole.

The above description is illustrative of the preferred embodiment and many modifications may be made by those skilled in the art without departing from the invention whose scope is to be determined from the literal and equivalent scope of the claims below.

We claim:

1. A subterranean tool mountable on a string for pressure generation at a desired depth to operate at least one second downhole tool, comprising:

a first and a second sub relatively movable with respect to each other and defining a variable volume chamber with at least one first connection in fluid communication with the second tool and a second connection for fluid movement with respect to a location other than said second tool, whereupon relative movement between said subs fluid in said chamber is available at said first connection under pressure for operation of said second tool, said relative movement being otherwise unrelated to the operation of said second tool;

said chamber is sealed against the annulus and insensitive to annulus hydrostatic pressure at said desired subterranean depth before or during any relative movement between said first and said second subs.

2. The tool of claim 1, wherein:

said subs are selectively retained to each other until a predetermined set down weight is applied.

3. The tool of claim 1, wherein:

said chamber further comprises an inlet that can allow fluid to enter said chamber when the volume of said chamber is increased by relative movement of said subs.

4. The tool of claim 3, wherein:

said inlet is closed by relative movement of said subs by advancing said inlet past a seal or a check valve mounted in said inlet.

5. The tool of claim 4, wherein:

said inlet is connected to at least one of a passage though said subs, an annular space around said subs or a reservoir on said subs.

6. The tool of claim 1, wherein:

pressure is generated at said first connection without running a control line downhole to said first connection.

7. The tool of claim 1, wherein:

pressure at said first connection can be applied and removed by relative movement of said subs.

8. A downhole tool mountable on a string for pressure generation at a desired depth to operate at least one second downhole tool, comprising:

a first and a second sub relatively movable with respect to each other and defining a variable volume chamber with at least one first connection in fluid communication with the second tool and a second connection for fluid movement into said chamber or out of said chamber from or to a location other than said second tool, whereupon relative movement between said subs fluid in said chamber is available at said first connection under pressure for operation of said second tool;

said chamber is exposed to hydrostatic pressure and further comprises at least one floating piston that separates said chamber into at least first and a second sub-chambers;

said first sub-chamber is exposed to hydrostatic pressures downhole and said second sub-chamber is in sealed fluid communication with said first connection;

whereupon relative movement between said subs the volume of both sub-chambers decreases and pressure is built up at said first connection to operate said second tool.

9. The tool of claim 8, wherein:

said chamber comprises at least two floating pistons defining an additional third chamber having said second connection apart from said first connection;

whereupon relative movement of said subs, pressure is developed through said connections at different times during said relative movement.

10. The tool of claim 9, wherein:

one of said connections contains a breakable member that retains built up pressure for release at a later or earlier time than the other connection.

11. The tool of claim 9, wherein:

said floating piston that separates said first and second sub-chambers contains a seal that is initially bypassed to allow fluid from said first and second sub-chambers to pressurize said first connection as said floating pistons move toward each other with relative movement of said subs.

12. The tool of claim 11, wherein:

said floating pistons move into contact with each other to pressurize said second connection at a later time than said first connection.

13. The tool of claim 9, wherein:

said first connection is directed to deliver fluid to opposed surfaces of a downhole wet connect before they contact each other for debris removal prior to contact and said second connection actuates a lock to hold the wet connect together after the opposed surfaces of said wet connect are in contact.

14. The tool of claim 13, wherein:

said subs are selectively retained to each other until a predetermined set down weight is applied.

15. The tool of claim 9, wherein:

said subs are selectively rotationally locked for torque transmission.

16. The tool of claim 8, wherein:

said chamber comprises at least two floating pistons defining an additional third chamber having said second connection apart from said first connection;

whereupon relative movement of said subs, pressure is developed through said connections at the same time during said relative movement.

17. The tool of claim 8, wherein:

said second sub-chamber further comprises an inlet that can allow fluid to enter said second sub-chamber when the volume of said second sub-chamber is increased by relative movement of said subs.

18. The tool of claim 8, wherein:

said subs are selectively retained to each other until a predetermined set down weight is applied.

19. The tool of claim 8, wherein:

said subs are selectively rotationally locked for torque transmission.

* * * * *